US012692613B2

(12) United States Patent
Umezawa

(10) Patent No.: US 12,692,613 B2
(45) Date of Patent: Jul. 28, 2026

(54) MASTER PLATE AND MANUFACTURING METHOD OF METAL FORMED ARTICLE

(71) Applicant: FUJIFILM CORPORATION, Tokyo (JP)

(72) Inventor: Tomokazu Umezawa, Kanagawa (JP)

(73) Assignee: FUJIFILM CORPORATION, Tokyo (JP)

( * ) Notice: Subject to any disclaimer, the term of this patent is extended or adjusted under 35 U.S.C. 154(b) by 534 days.

(21) Appl. No.: 18/346,877

(22) Filed: Jul. 5, 2023

(65) Prior Publication Data

US 2023/0357943 A1 Nov. 9, 2023

Related U.S. Application Data

(63) Continuation of application No. PCT/JP2022/000781, filed on Jan. 12, 2022.

(30) Foreign Application Priority Data

Jan. 21, 2021 (JP) ..... 2021-008220

(51) Int. Cl.
*C25D 1/10* (2006.01)

(52) U.S. Cl.
CPC ..... *C25D 1/10* (2013.01)

(58) Field of Classification Search
None
See application file for complete search history.

(56) References Cited

U.S. PATENT DOCUMENTS

2005/0233564 A1 10/2005 Kitada et al.
2009/0071837 A1* 3/2009 Fredenberg ..... C25D 5/02 205/640

(Continued)

FOREIGN PATENT DOCUMENTS

JP S57-80795 A 5/1982
JP H05-239682 A 9/1993

(Continued)

OTHER PUBLICATIONS

English language translation of the following: Office action dated Sep. 30, 2025 from the JPO in a Japanese patent application No. 2022-576623 corresponding to the instant patent application.

(Continued)

*Primary Examiner* — Louis J Rufo
(74) *Attorney, Agent, or Firm* — SOLARIS Intellectual Property Group, PLLC

(57) ABSTRACT

In a master plate having an electrodeposition surface in which a metal formed article is formed by electrodeposition, and having a product region and a non-product region in the electrodeposition surface, the master plate includes: a product pattern that is formed in the product region and includes a recess and a protrusion; and a dummy pattern that is formed in at least a partial region of the non-product region and includes a plurality of recesses and a plurality of protrusions, the dummy pattern in which, in a case where a surface area of the product pattern per unit area of the product region is a first surface area, and a surface area of the dummy pattern per unit area of a dummy region in which the dummy pattern is formed is a second surface area, the second surface area is larger than the first surface area.

13 Claims, 15 Drawing Sheets

(56) References Cited

U.S. PATENT DOCUMENTS

| | | | |
|---|---|---|---|
| 2012/0027998 | A1 | 2/2012 | Ibn-Elhaj et al. |
| 2015/0352831 | A1 | 12/2015 | Coleman et al. |
| 2020/0208284 | A1 | 7/2020 | Kim |

FOREIGN PATENT DOCUMENTS

| | | | | |
|---|---|---|---|---|
| JP | 2003-072021 | A | | 3/2003 |
| JP | 2005-310807 | A | | 11/2005 |
| JP | 2010-086579 | A | | 4/2010 |
| JP | 2012-517919 | A | | 8/2012 |
| JP | 2015030881 | A | * | 2/2015 |
| JP | 2016-182709 | A | | 10/2016 |
| WO | 2006/068175 | A1 | | 6/2006 |

OTHER PUBLICATIONS

Extended European Search Report dated Nov. 14, 2024, issued in corresponding EP Patent Application No. 22742479.3.
International Search Report issued in International Application No. PCT/JP2022/000781 on Apr. 5, 2022.
Written Opinion of the ISA issued in International Application No. PCT/JP2022/000781 on Apr. 5, 2022.
Partial Supplementary European Search Report dated Jun. 19, 2024, issued in corresponding EP Patent Application No. 22742479.3.

* cited by examiner

MASTER PLATE AND MANUFACTURING METHOD OF METAL FORMED ARTICLE

CROSS-REFERENCE TO RELATED APPLICATIONS

This application is a continuation of International Application No. PCT/JP2022/000781, filed on Jan. 12, 2022, which claims priority from Japanese Patent Application No. 2021-008220, filed on Jan. 21, 2021. The entire disclosure of each of the above applications is incorporated herein by reference.

BACKGROUND

1. Technical Field

The present disclosure relates to a master plate for electroforming and a manufacturing method of a metal formed article.

2. Related Art

A master plate for manufacturing a metal formed article having unevenness by electroforming is known (for example, refer to JP2015-30881A). Such a master plate has an electrodeposition surface in which a metal formed article is formed by electrodeposition, and an uneven pattern is formed in the electrodeposition surface, for example, by a resist. In an electroforming procedure, a metal formed article is grown by precipitating metal on the electrodeposition surface in a state where the master plate in which uneven pattern is formed is immersed in plating liquid. Then, the grown metal formed article is peeled from the master plate. The metal formed article thus obtained has, for example, reversed unevenness of the uneven pattern of the master plate.

In addition, in JP2015-30881A, an opening plate having a plurality of openings such as a nozzle plate that eject ink of an inkjet printer or a filter plate used for filtration is mentioned as a metal formed article.

JP2015-30881A discloses using a master plate in which, around an uneven pattern for a plate for forming an opening of an opening plate, a dummy resist pattern of a dimension smaller than the uneven pattern for the plate is formed. According to a technology of JP2015-30881A, current density distribution in and around the uneven pattern for the plate is made uniform by electroforming using the master plate comprising a dummy pattern around the uneven pattern for the plate. Accordingly, it is possible to make a thickness of an electrodeposition layer formed in all regions of the uneven pattern for the plate uniform.

SUMMARY

As described in JP2015-30881A, a part of the metal formed article formed by the master plate is cut out as a product after the metal formed article is peeled from the master plate. An electroforming surface of such a master plate is provided with a product region in which a product part, which is cut out as a product from a metal formed article, is formed and a non-product region other than the product region. In JP2015-30881A, the product region is a region where a product pattern such as the uneven pattern for the plate is formed. The dummy pattern is formed on at least a part of the non-product region such as around the product pattern.

In the master plate of JP2015-30881A, for example, in a case where a dimension of a recess or a protrusion included in the product pattern is small or a density of a recess or a protrusion is low, there is a case where a metal formed article is peeled from the master plate during electroforming.

The present disclosure has been made in view of the circumstance described above, and an object of the present disclosure is to provide a master plate and a manufacturing method of a metal formed article, which can suppress peeling of a metal formed article that is growing in an electroforming step.

A master plate according to an aspect of the present disclosure is a master plate having an electrodeposition surface in which a metal formed article is formed by electrodeposition, and having a product region in which a product part, which is cut out as a product from the metal formed article, is formed and a non-product region other than the product region in the electrodeposition surface, the master plate comprising a product pattern that is formed in the product region and includes a recess and a protrusion, and a dummy pattern that is formed in at least a partial region of the non-product region and includes a plurality of recesses and a plurality of protrusions, the dummy pattern in which, in a case where a surface area of the product pattern per unit area of the product region is a first surface area, and a surface area of the dummy pattern per unit area of a dummy region in which the dummy pattern is formed is a second surface area, the second surface area is larger than the first surface area.

In the master plate according to an aspect of the present disclosure, it is preferable that an area of the dummy region is larger than that of the product region.

In the master plate according to an aspect of the present disclosure, it is preferable that the plurality of recesses or protrusions are regularly arranged in the dummy region.

In the master plate according to an aspect of the present disclosure, it is preferable that the product pattern includes at least one of a plurality of the recesses or a plurality of the protrusions, and the plurality of the recesses or the plurality of the protrusions are regularly arranged in the product pattern, and an arrangement pitch of the plurality of recesses or the plurality of protrusions of the dummy pattern is smaller than an arrangement pitch of the recesses or the protrusions of the product pattern.

In the master plate according to an aspect of the present disclosure, it is preferable that a height of the protrusion of the dummy pattern is higher than a height of the protrusion of the product pattern.

In the master plate according to an aspect of the present disclosure, it is preferable that an aspect ratio of the protrusion or the recess of the dummy pattern is larger than an aspect ratio of the protrusion or the recess of the product pattern.

In the master plate according to an aspect of the present disclosure, it is preferable that each of the dummy pattern and the product pattern has a bottom surface and the protrusion protruding from the bottom surface, and an angle formed by a side wall of the protrusion and the bottom surface of the dummy pattern is smaller than an angle formed by a side wall of the protrusion and the bottom surface of the product pattern.

In the master plate according to an aspect of the present disclosure, it is preferable that the dummy pattern has a bottom surface and the protrusion protruding from the bottom surface, and an angle formed by a side wall of the protrusion and the bottom surface of the dummy pattern is 90° or less.

In the master plate according to an aspect of the present disclosure, a planar shape of the electrodeposition surface may be a circular shape, and three of the product regions may be provided around a center of the electrodeposition surface in a three-fold rotationally symmetric manner, and the dummy pattern may be provided in a region surrounded by the three product regions.

In the master plate according to an aspect of the present disclosure, the master plate may include a conductive substrate that has the electrodeposition surface, and a nonconductive mask that is formed on the electrodeposition surface and controls growth of the metal formed article, and the protrusion of the product pattern and the protrusion of the dummy pattern may be the nonconductive mask.

In the master plate according to an aspect of the present disclosure, a material of the nonconductive mask forming at least one of the protrusion of the product pattern or the protrusion of the dummy pattern may be a photosensitive resin.

In the master plate according to an aspect of the present disclosure, a material of the nonconductive mask forming at least one of the protrusion of the product pattern or the protrusion of the dummy pattern may be an inorganic material.

In the master plate according to an aspect of the present disclosure, at least one of the protrusion of the product pattern or the protrusion of the dummy pattern may be formed of a conductive material, and the other one may be formed of a nonconductive material.

A manufacturing method of a metal formed article according to an aspect of the present disclosure comprises an electroforming step of growing, in a state where the master plate is immersed in an electroforming liquid, the metal formed article by precipitating metal on the electrodeposition surface, and a peeling step of peeling the metal formed article from the master plate.

In the manufacturing method of a metal formed article according to an aspect of the present disclosure, it is preferable that a water contact angle of a surface of the protrusion of the product pattern of the master plate is 20° or less.

According to the master plate and the manufacturing method of a metal formed article according to an aspect of the present disclosure, it is possible to suppress peeling of a metal formed article during growth in the electroforming step.

Figure 2:
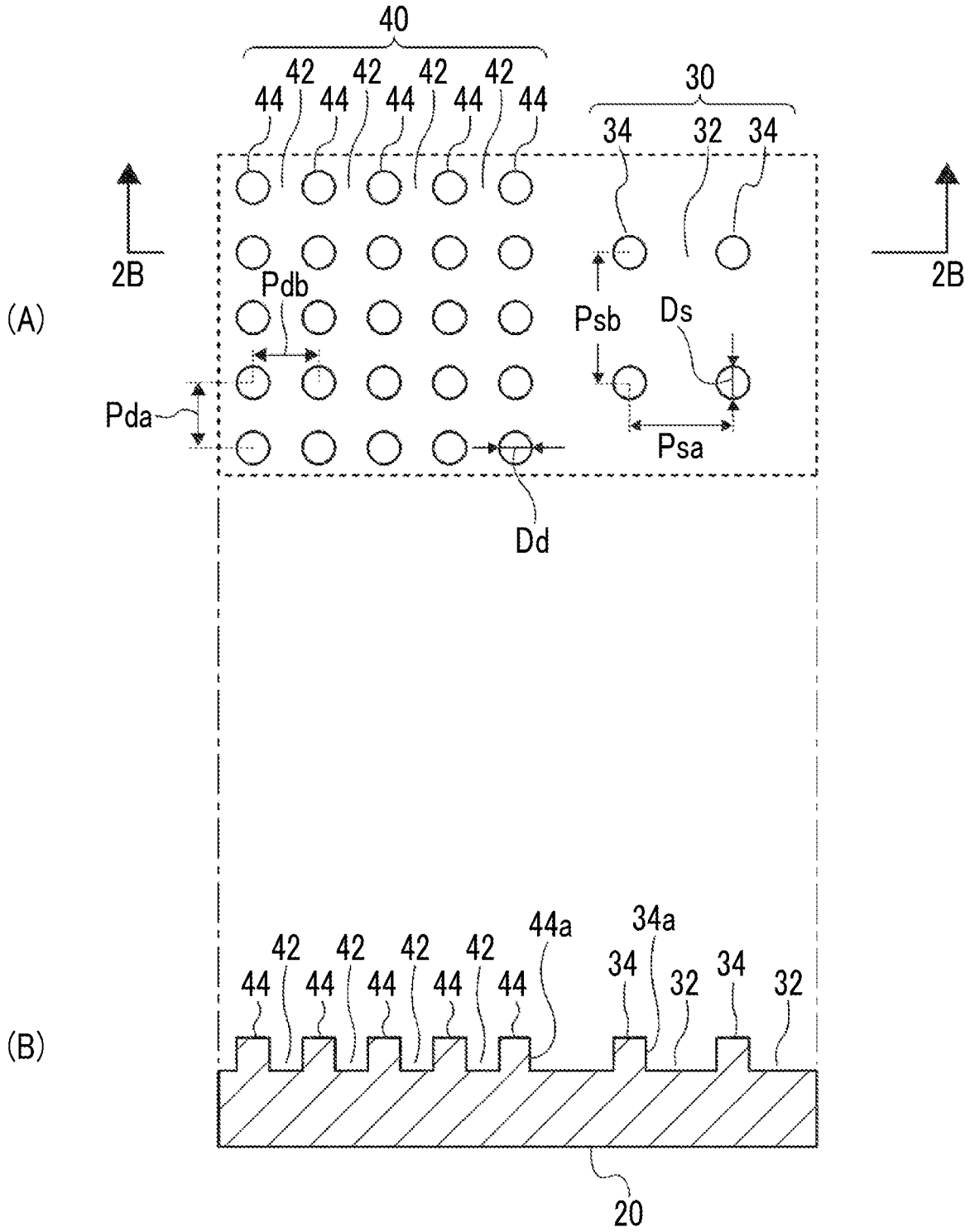

(A) of FIG. 2 is an enlarged plan view of a part of the master plate according to one embodiment, and (B) of FIG. 2 is a cross-sectional view.

Figure 3:
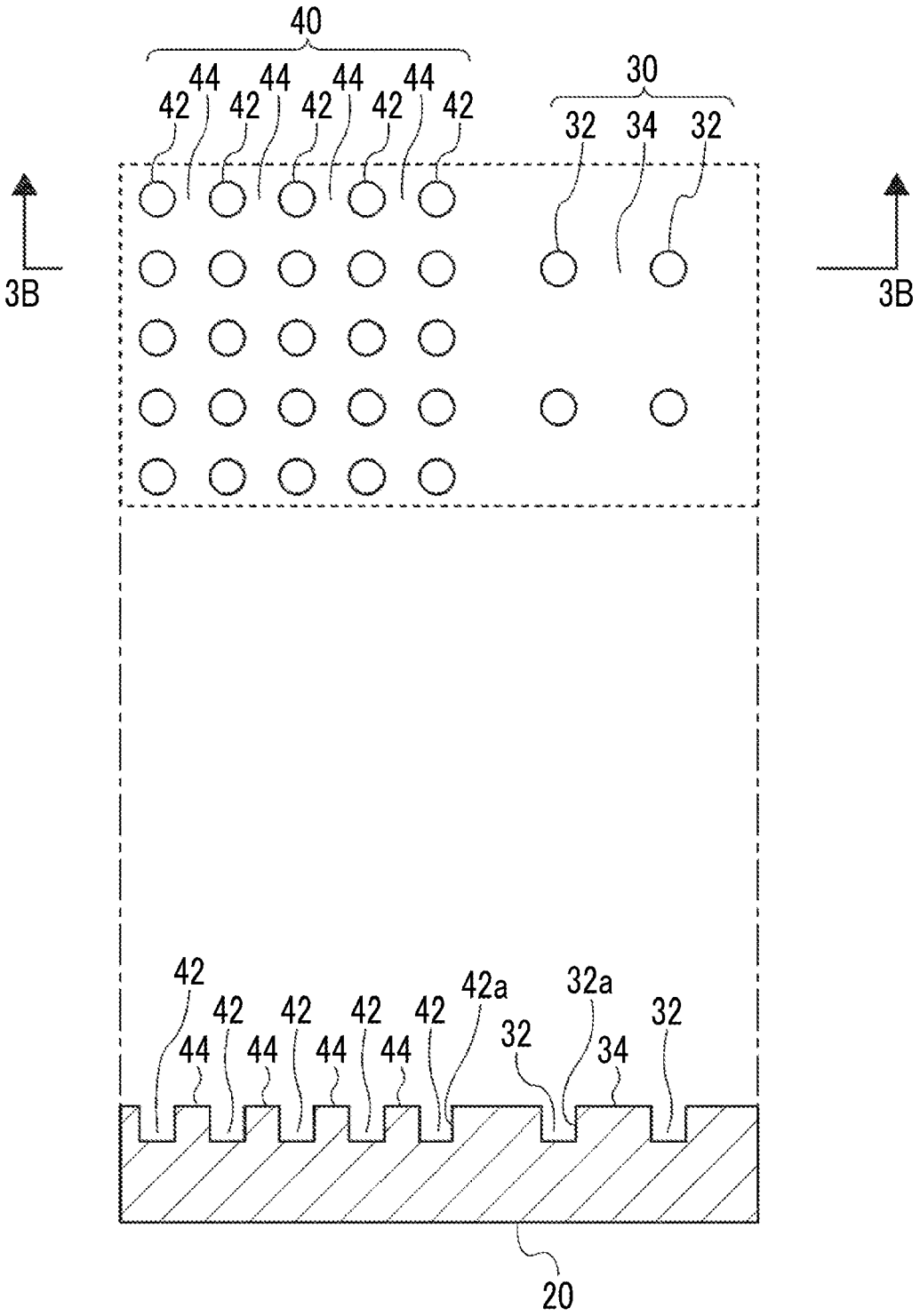

(A) of FIG. 3 is an enlarged plan view of a part of the master plate having a recess-type uneven pattern, and (B) of FIG. 3 is a cross-sectional view.

Figure 4:
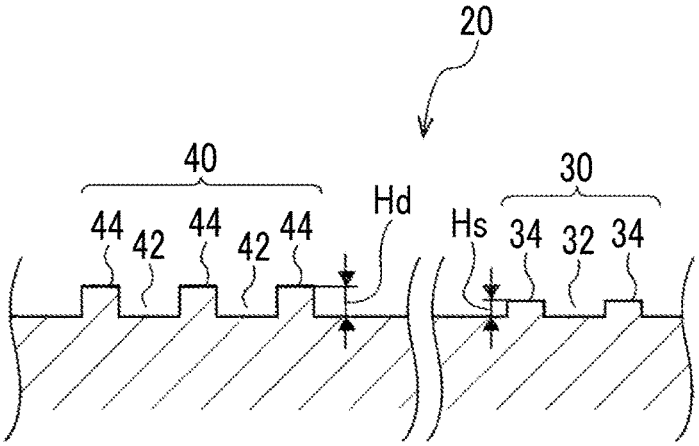

FIG. 4 is an explanatory diagram of heights of a protrusion of a product pattern and a protrusion of a dummy pattern.

Figure 5:
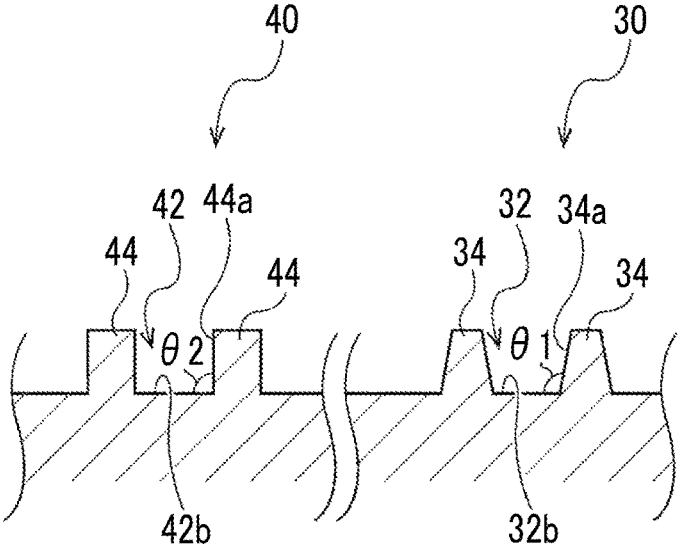

FIG. 5 is an explanatory diagram of an angle formed by a side wall of the protrusion of the product pattern and a bottom surface of the product pattern and an angle formed by a side wall of the protrusion and a bottom surface of the dummy pattern.

Figure 6:
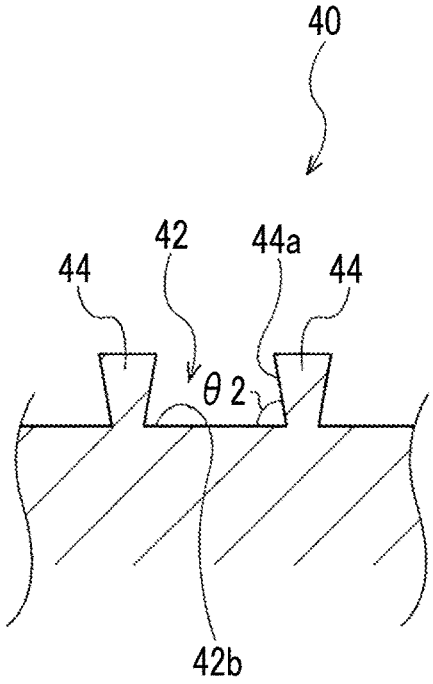

FIG. 6 is an explanatory diagram of an angle formed by the side wall of the protrusion and the bottom surface of the dummy pattern.

Figure 7:
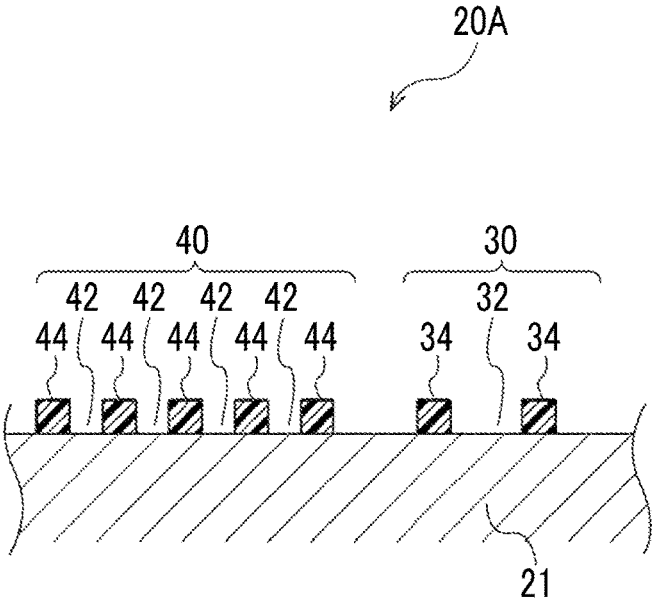

FIG. 7 is a cross-sectional view showing a specific configuration example 20A of a master plate 20.

Figure 8:
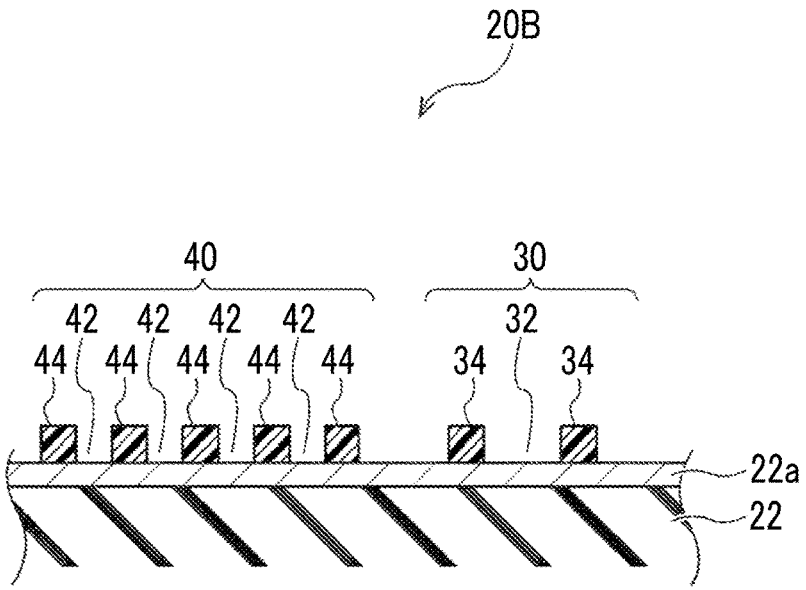

FIG. 8 is a cross-sectional view showing a specific configuration example 20B of the master plate 20.

Figure 9:
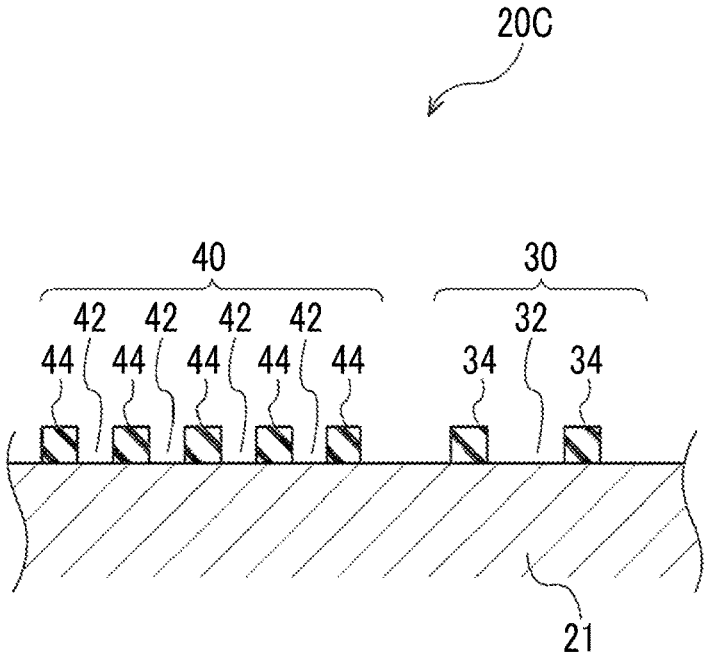

FIG. 9 is a cross-sectional view showing a specific configuration example 20C of the master plate 20.

Figure 10:
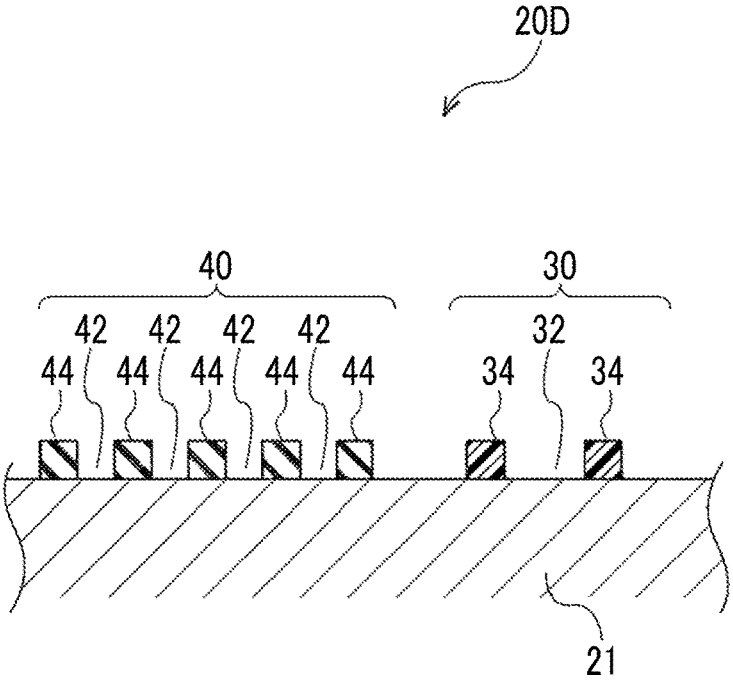

FIG. 10 is a cross-sectional view showing a specific configuration example 20D of the master plate 20.

Figure 11:
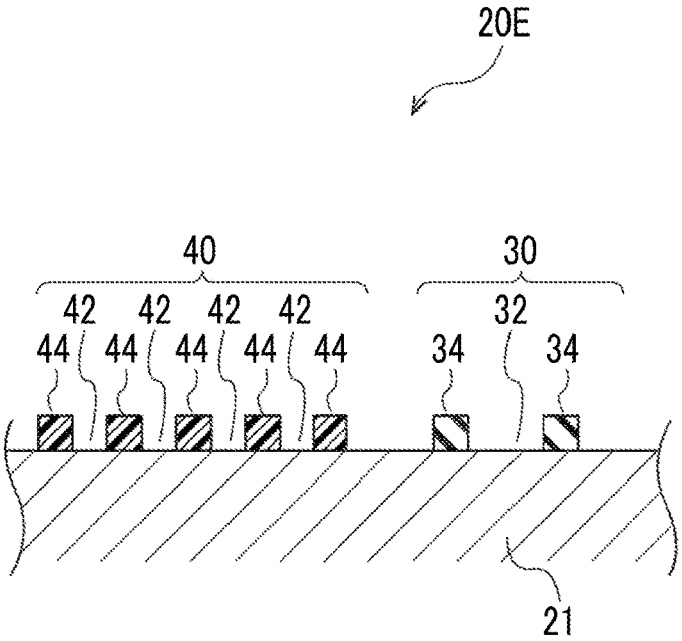

FIG. 11 is a cross-sectional view showing a specific configuration example 20E of the master plate 20.

Figure 12:
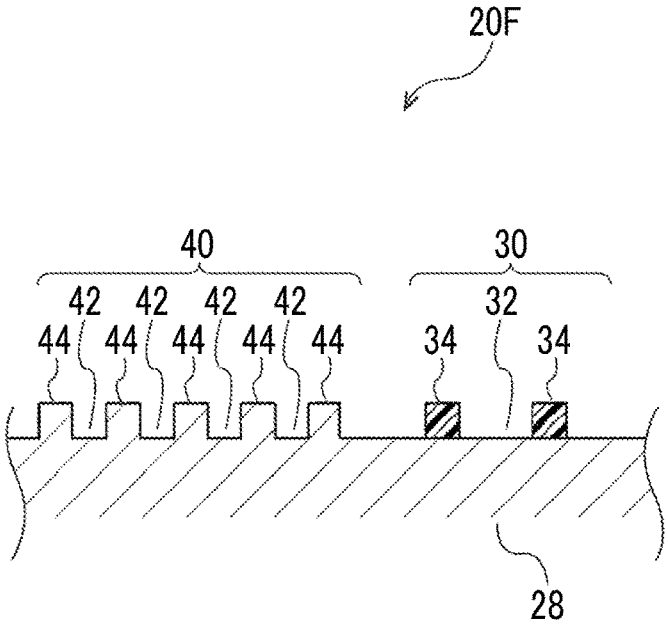

FIG. 12 is a cross-sectional view showing a specific configuration example 20F of the master plate 20.

Figure 13:
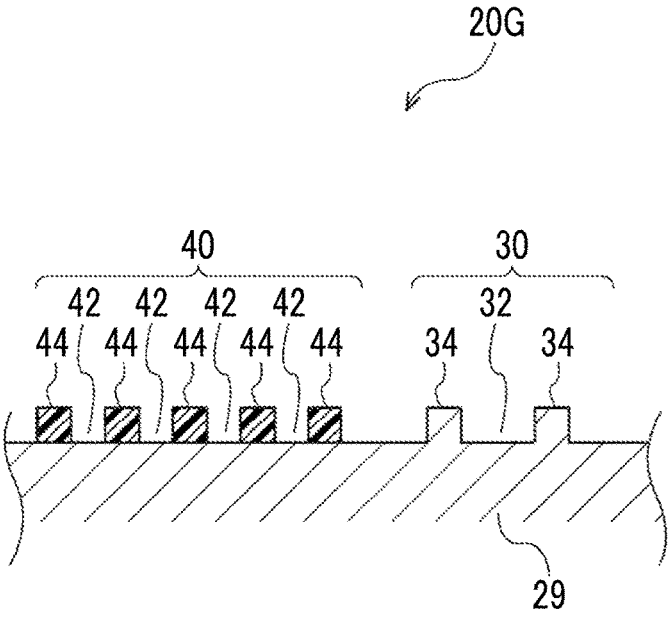

FIG. 13 is a cross-sectional view showing a specific configuration example 20G of the master plate 20.

Figure 14:
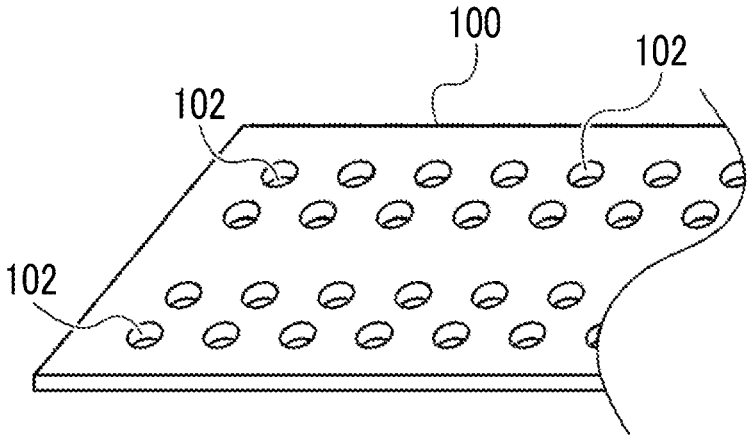

FIG. 14 is a perspective view showing a part of a nozzle plate.

Figure 15:
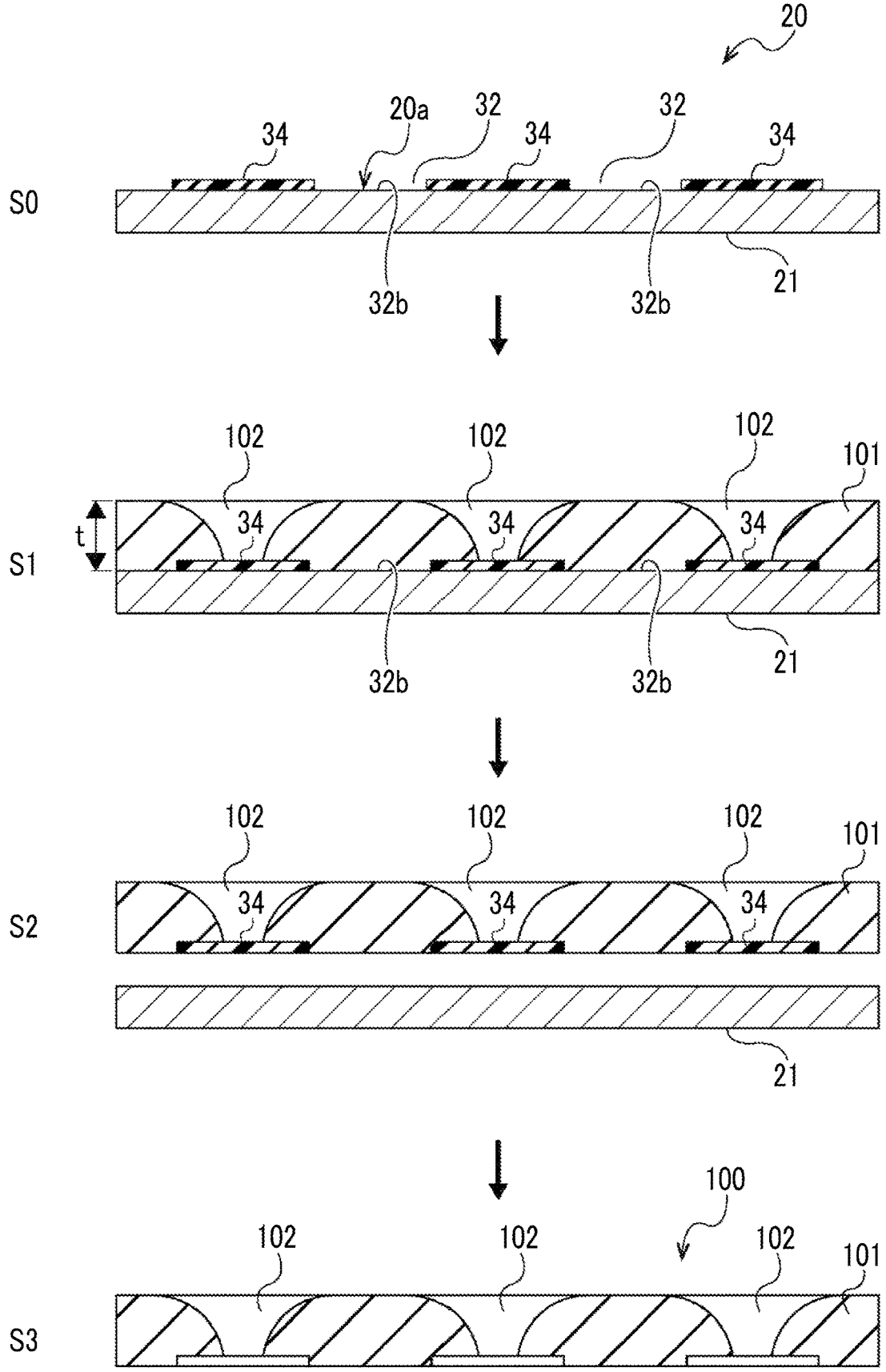

FIG. 15 is a diagram showing a manufacturing step of the nozzle plate.

Figure 16:
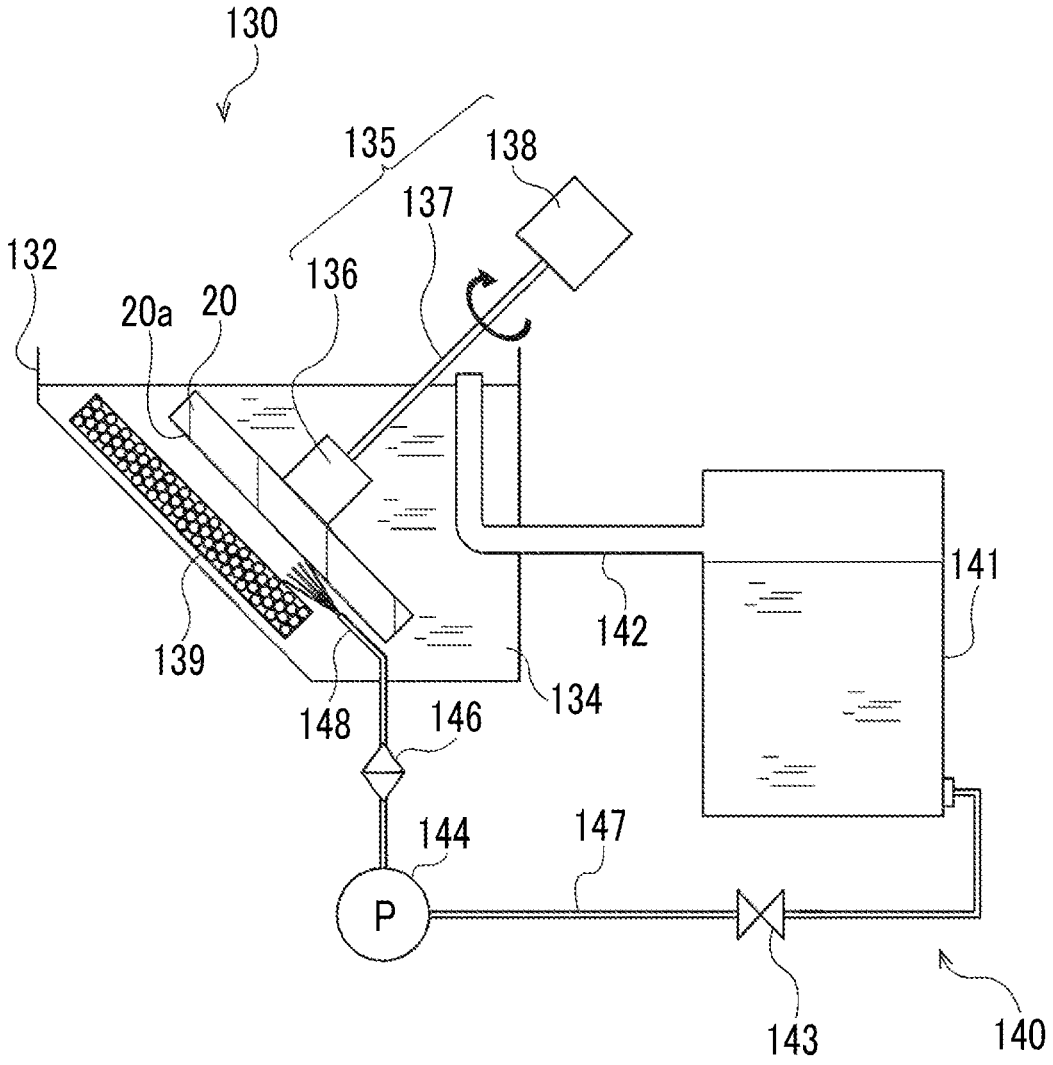

FIG. 16 is a diagram showing an example of an electroforming apparatus.

Figure 17:
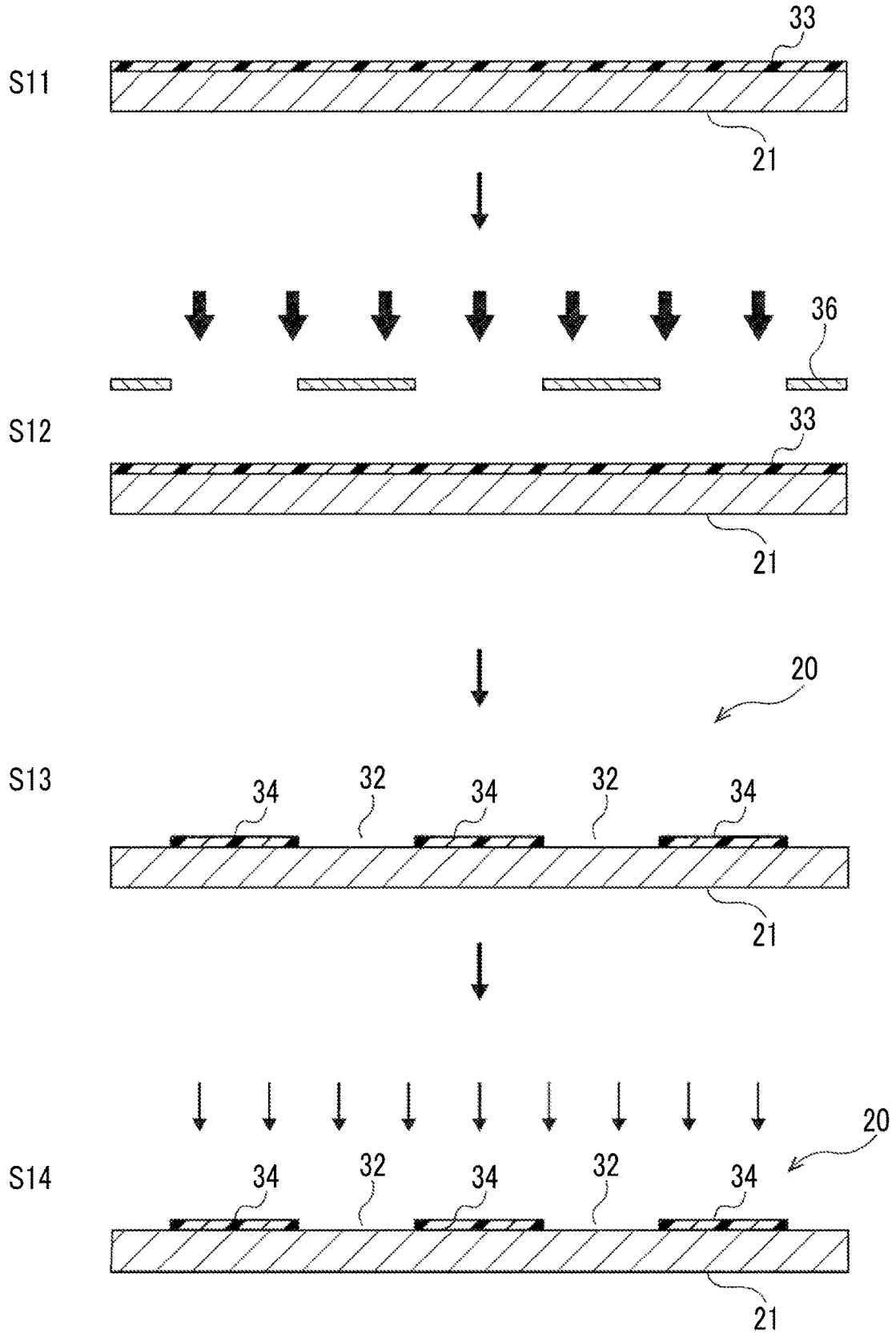

FIG. 17 is a diagram showing a producing step of the master plate.

Figure 18:
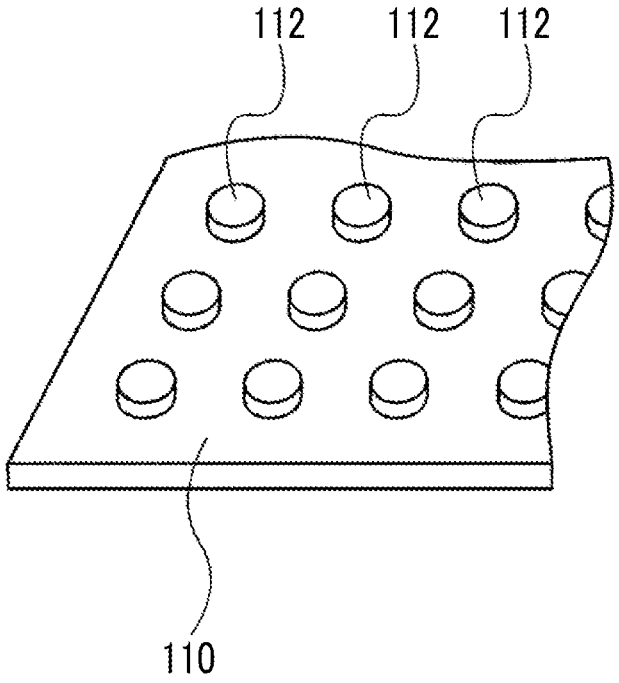

FIG. 18 is a perspective view showing a part of a mold.

Figure 19:
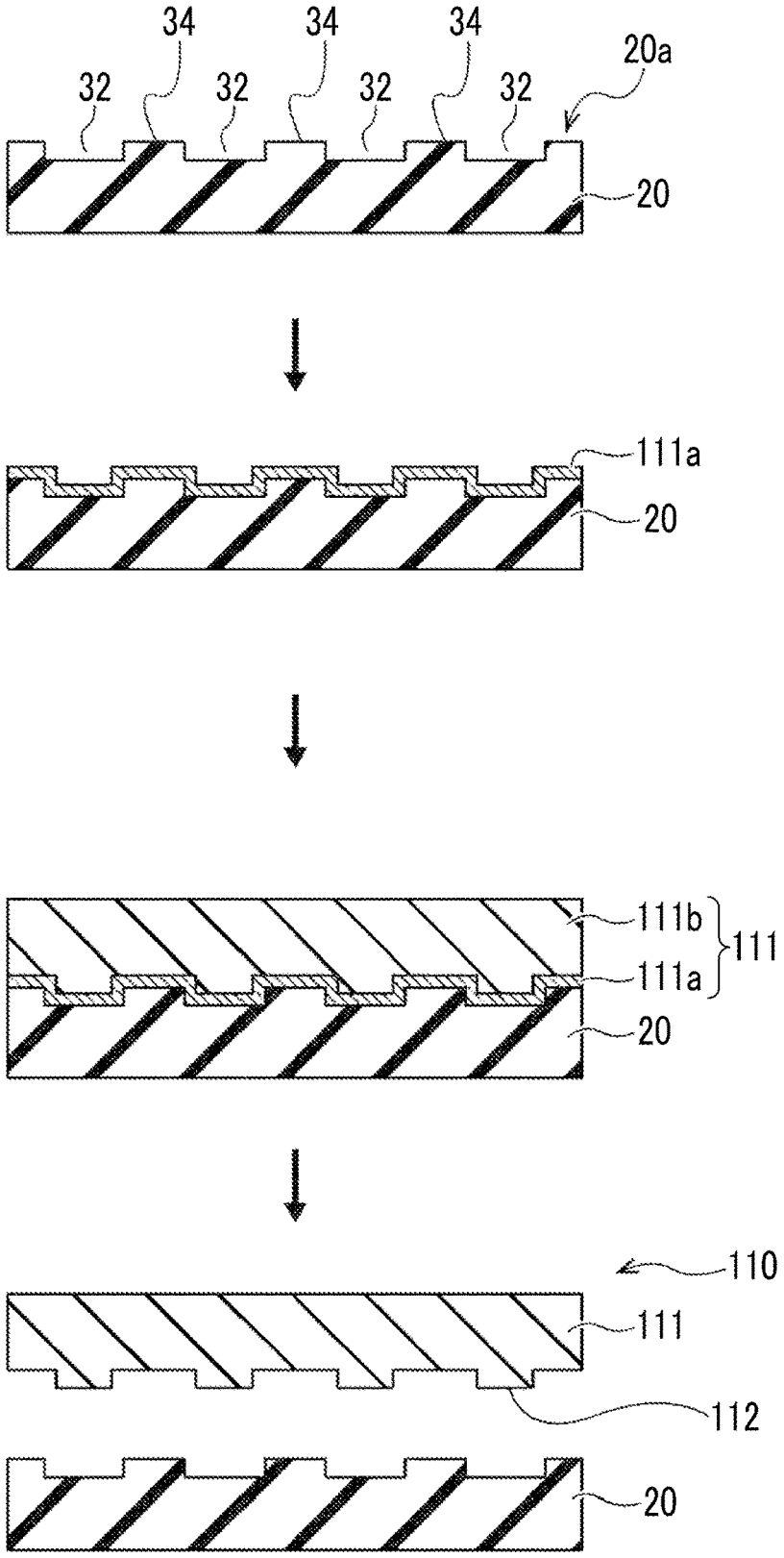

FIG. 19 is a diagram showing a manufacturing step of a mold.

DESCRIPTION OF EMBODIMENTS

Hereinafter, embodiments of the present disclosure will be described with reference to the drawings.

"Master Plate"

Figure 1A:
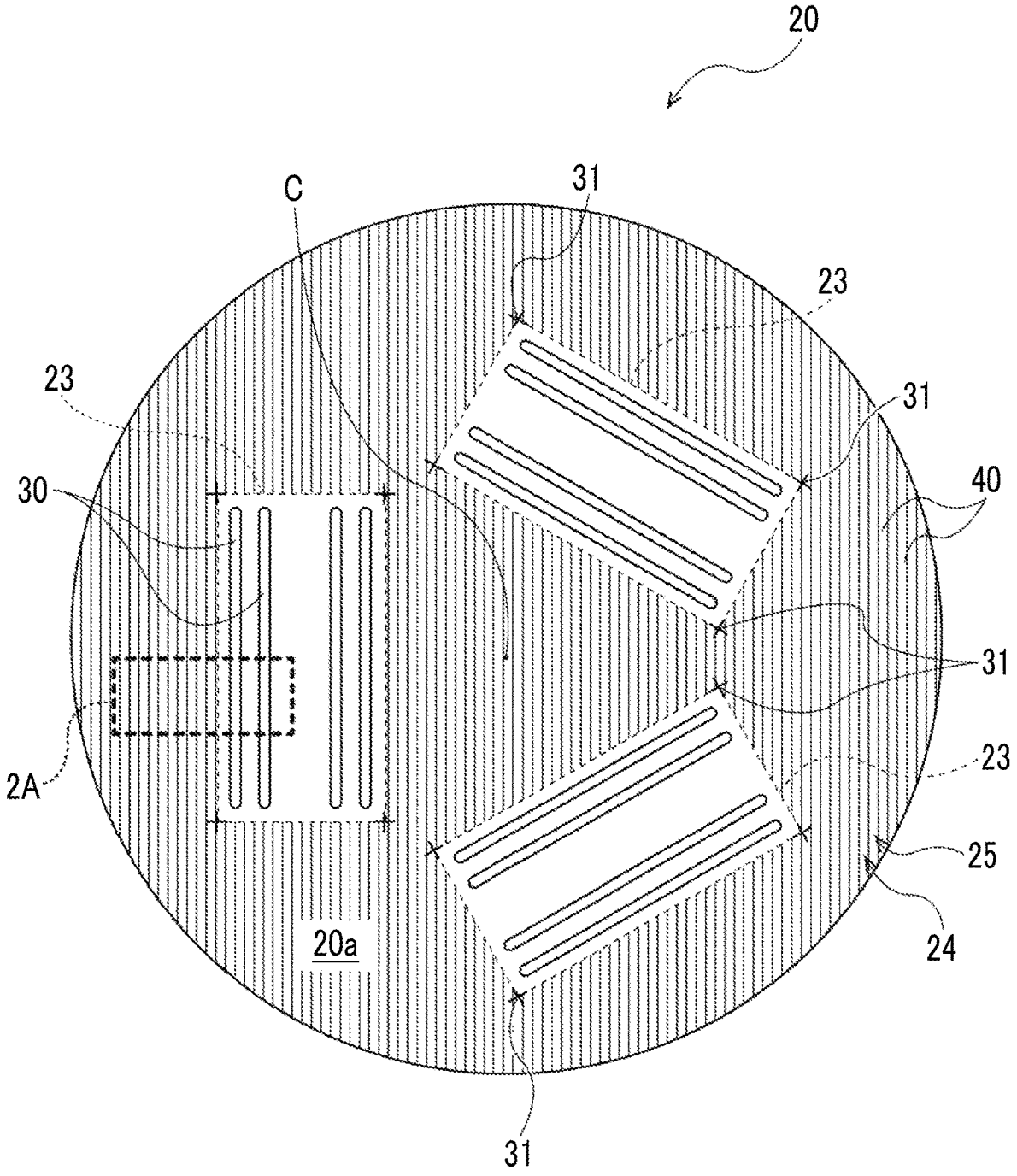
FIG. 1A is a plan view of a master plate of one embodiment.

FIG. 1A is a plan view of a master plate 20 according to one embodiment, FIG. 2 is an enlarged view showing a part of the master plate 20, and (A) of FIG. 2 is a plan view and (B) of FIG. 2 is a cross-sectional view.

A master plate 20 is used for manufacturing a metal formed article by electroforming. The master plate 20 has an electrodeposition surface 20*a* on which a metal formed article is formed by electrodeposition. In the electrodeposition surface 20*a*, the master plate 20 has a product region 23 in which a product part, which is cut out as a product from a metal formed article, is formed, and a non-product region 24 other than the product region 23. Further, the master plate 20 includes a product pattern 30 that is formed in the product region 23 and includes a recess 32 and a protrusion 34, and a dummy pattern 40 that is formed in at least a partial region of the non-product region 24 and includes a plurality of recesses 42 and a plurality of protrusions 44. Here, in a case where a surface area of the product pattern 30 per unit area of the product region 23 is a first surface area S1, and a surface area of the dummy pattern 40 per unit area of a dummy region 25 in which the dummy pattern 40 is formed is a second surface area S2, the dummy pattern 40 is a pattern in which the second surface area S2 is larger than the first surface area S1.

The product region 23 is, for example, a region surrounded by a broken line in the drawing, and is defined by an alignment mark 31 in the present example. In the master plate 20 of the present example, in the electrodeposition surface 20*a* of which a planar shape is a circular shape, three product regions 23 are provided around a center C of the electrodeposition surface 20*a* in a three-fold rotationally symmetric manner. In the electrodeposition surface 20*a*, all of a region other than the product region 23 is the non-product region 24. In the present example, the dummy region 25 is formed over substantially the entire region of the non-product region 24.

An example of an uneven pattern including a recess and a protrusion includes an uneven pattern formed by forming a recess in a plane (hereinafter, referred to as "recess-type pattern") and an uneven pattern formed by forming a protrusion in a plane (hereinafter, referred to as "protrusion-type pattern"). In the master plate 20 shown in FIG. 2, both an uneven pattern of the product pattern 30 and an uneven pattern of the dummy pattern 40 are protrusion-type patterns. On the other hand, FIG. 3 shows an enlarged plan view ((A) of FIG. 3) of a part of the master plate 20 and a cross-sectional view ((B) of FIG. 3) of the part of the master plate 20 in a case where both an uneven pattern of the product pattern 30 of the master plate 20 and an uneven pattern of the dummy pattern 40 of the master plate 20 are recess-type patterns. Note that one master plate 20 may include a protrusion-type pattern and a recess-type pattern, in which, for example, the product pattern 30 is a protrusion-type pattern and the dummy pattern 40 is a recess-type pattern. Regardless of whether an uneven pattern is a protrusion-type pattern or a recess-type pattern, the uneven pattern includes a bottom surface and the protrusion 34 or 44 protruding from the bottom surface. Here, the bottom surface corresponds to an inner bottom surface of the recess 32 or 42 (refer to FIGS. 2 and 3).

A surface area of the product pattern 30 is a sum of an area Sp of the product region 23 in a plan view and an area Ss1 of a side wall 32*a* of the recess 32 or a side wall 34*a* of the protrusion 34 of the product pattern 30. Therefore, a surface area (first surface area S1) per unit area of the product pattern 30 is represented by S1=(Sp+Ss1)/Sp.

As shown in FIG. 2, in a case where the product pattern 30 is a protrusion-type pattern, a surface area of the product pattern 30 is a sum of an area of the product region 23 in a plan view and an area of the side wall 34*a* of the protrusion 34 of the product pattern 30.

As shown in FIG. 3, in a case where the product pattern 30 is a recess-type pattern, a surface area of the product pattern 30 is a sum of an area of the product region 23 in a plan view and an area of the side wall 32*a* of the recess 32 of the product pattern 30.

In a case where there are a plurality of product regions 23 as shown in FIG. 1A, a surface area per unit area of the product pattern 30 is an average value of surface areas per unit area in all the product regions.

A surface area of the dummy pattern 40 is a sum of an area Sd of the dummy region 25 in a plan view and an area Ss2 of a side wall 42*a* of the recess 42 or a side wall 44*a* of the protrusion 44 of the dummy pattern 40. Therefore, a surface area (second surface area S2) per unit area of the dummy pattern 40 is represented by S2=(Sd+Ss2)/Sd.

As shown in FIG. 2, in a case where the dummy pattern 40 is a protrusion-type pattern, a surface area of the dummy pattern 40 is a sum of an area of the dummy region 25 in a plan view and an area of the side wall 44*a* of the protrusion 44 of the dummy pattern 40.

As shown in FIG. 3, in a case where the dummy pattern 40 is a recess-type pattern, a surface area of the dummy pattern 40 is a sum of an area of the dummy region 25 in a plan view and an area of the side wall 42*a* of the recess 42 of the dummy pattern 40.

In a case where there are a plurality of dummy regions 25, a surface area per unit area of the dummy pattern 40 is an average value of surface areas per unit area in all the dummy regions.

Figure 1B:
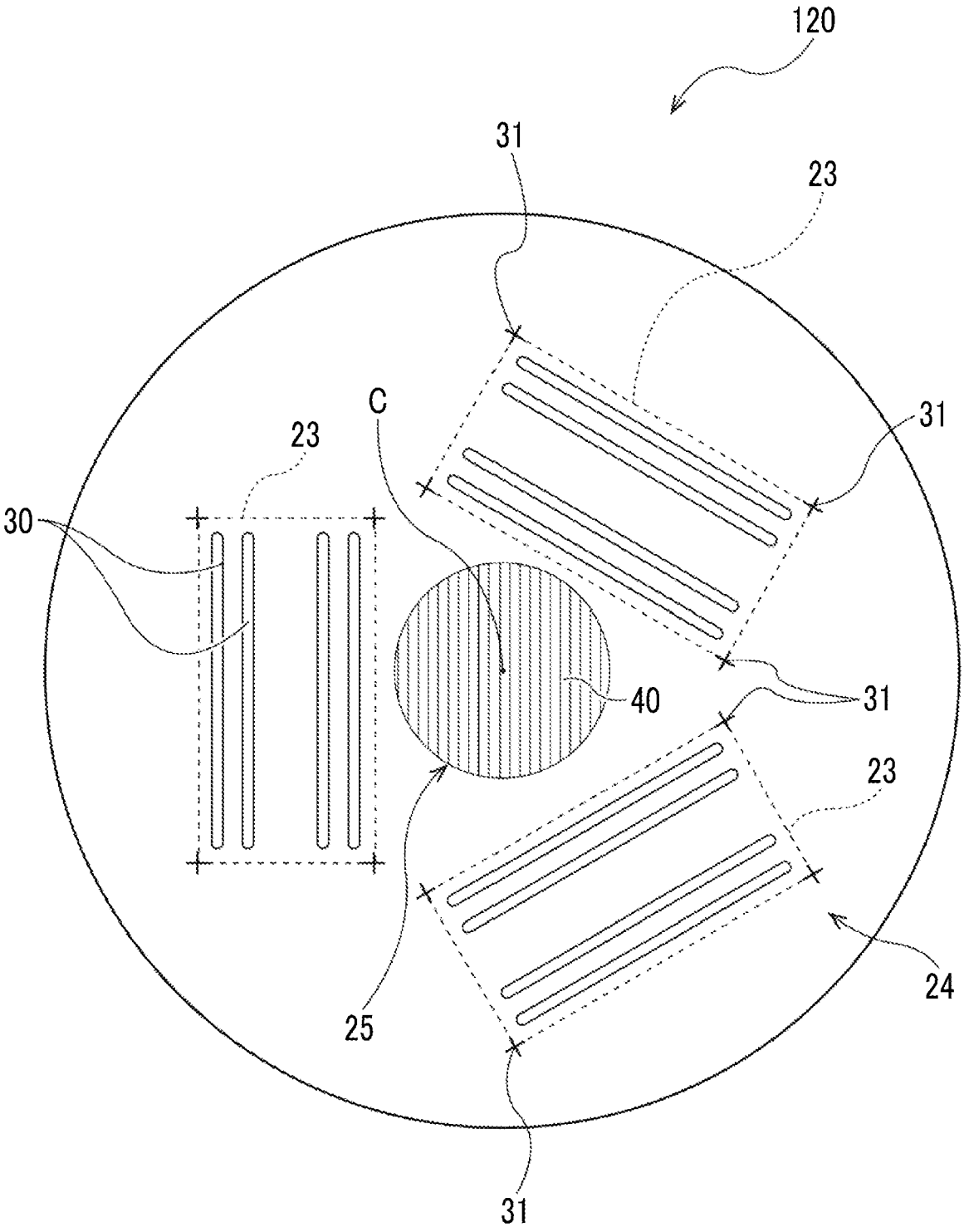
FIG. 1B is a plan view of a master plate of a design modification example.

A dummy region 25 refers to a closed region in which the dummy pattern 40 is formed in the non-product region 24. In the master plate 20 shown in FIG. 1A, the dummy pattern 40 is formed over the entire region of the non-product region 24, and the entire non-product region 24 corresponds to the dummy region 25. As in a master plate 120 shown in FIG. 1B, a dummy region 25 may be partially formed in a non-product region 24. In FIG. 1B, components equivalent to components of the master plate 20 shown in FIG. 1A and FIG. 2 are designated by the same reference numerals. The same applies to the following drawings. In the master plate 120 shown in FIG. 1B, a dummy pattern 40 is formed in a region surrounded by three product regions 23, and a region in which the dummy pattern 40 is formed is the dummy region 25. In a case where the dummy pattern 40 is a protrusion-type pattern and a dummy region 25 is partially formed in the non-product region 24, the dummy region 25 is a region surrounding an outer periphery of protrusions 44 located at an outermost part among a plurality of protrusions 44 formed in the non-product region 24. In addition, in a case where the dummy pattern 40 is a recess-type pattern and the dummy region 25 is partially formed in the non-product region 24, the dummy region 25 is a region surrounding an outer periphery of recesses 42 located at an outermost part among a plurality of recesses 42 formed in the non-product region 24. The dummy region 25 is not limited to an aspect where the dummy region 25 is provided at one location in a center of a master plate as shown in FIG. 1B, may be provided at any location as long as the location is within a non-product region 24, is not limited to one location, and may be formed scattered at a plurality of locations.

A size and density of a recess or a protrusion of a product pattern are determined by product specifications and thus cannot be changed. In a case where a surface area of a recess or a protrusion of a product pattern is small, adhesiveness to an electrodeposition layer is low, and there is a concern that peeling occurs between the electrodeposition layer and a master plate during electroforming. In JP2015-30881A, since a dummy pattern is provided around a product pattern, an anchor effect due to the dummy pattern can also be expected. However, in JP2015-30881A, a dimension of a recess or a protrusion of the dummy pattern is smaller than that of a product pattern. Therefore, there is a concern that the anchor effect of the dummy pattern is smaller than an anchor effect of the product pattern, and a needed anchor effect cannot be obtained. However, in the present master plate 20, since a surface area per unit area of a dummy region is larger than a surface area per unit area of a product region, a high anchor effect can be exhibited, adhesiveness can be further enhanced, and a peeling suppression effect during electroforming can be sufficiently exhibited.

In the master plate 20 or 120, it is preferable that an area of the dummy region 25 is larger than that of the product region 23. In a case where an area of the dummy region 25 and an area of the product region 23 are compared in the master plate 20 or 120, a total area of all the dummy regions 25 formed in one master plate 20 or 120 and a total area of all the product regions 23 formed in one master plate 20 or 120 are compared. For example, in a case of the master plate 120 shown in FIG. 1B, it is preferable that an area of one dummy region 25 is larger than a total area of the three product regions 23. In a case where an area of the dummy region 25 is larger than that of the product region 23, an anchor effect during electroforming is high, and the peeling suppression effect can be enhanced.

In the master plate 20 shown in FIGS. 1A and 2, the plurality of recesses 42 or protrusions 44 are regularly arranged in the dummy region 25. However, recesses 42 and protrusions 44 formed in the dummy region 25 are not limited to the regular arrangement and may be irregularly arranged. In addition, the dummy pattern 40 may be a pattern in which irregular recesses or protrusions are formed by surface roughening such as a satin finish.

In the present embodiment, in the master plate 20, the product pattern 30 includes at least one of the plurality of recesses 32 or the plurality of protrusions 34, and in the product pattern 30, the plurality of recesses 32 or the plurality of protrusions 34 are regularly arranged. The plurality of recesses 42 and the plurality of protrusions 44 are regularly arranged also in the dummy pattern 40.

In such a case, it is preferable that an arrangement pitch of the recesses 42 or the protrusions 44 of the dummy pattern 40 is smaller than an arrangement pitch of the recesses 32 or the protrusions 34 of the product pattern 30. That is, in the dummy region 25, it is preferable that the recesses 42 or the protrusions 44 are formed with a density higher than an arrangement density of the recesses 32 or the protrusions 34 in the product region 23. In a case where an arrangement pitch of the recesses 42 or the protrusions 44 of the dummy pattern 40 is smaller than an arrangement pitch of the recesses 32 or the protrusions 34 of the product pattern 30, the second surface area S2 can be easily made larger than the first surface area S1.

In a case where the product pattern 30 is a protrusion-type pattern and, as shown in FIG. 2, is a pattern in which the plurality of protrusions 34 are arranged and formed two-dimensionally to be spaced apart from each other, the arrangement pitch of protrusions 34 of the product pattern 30 is an average value of arrangement pitches Psa and Psb in respective directions of two orthogonal axes. In a case of a pattern in which a plurality of protrusions 34 are arranged and formed to be spaced apart from each other in one direction, the arrangement pitch of the protrusions 34 of the product pattern 30 is the arrangement pitch of the protrusions 34 in the one direction.

In a case where the product pattern 30 is a recess-type pattern, for the arrangement pitch of the recesses 32 of the product pattern 30, the protrusions 34 are replaced with the recesses 32 in the above description.

In a case where the dummy pattern 40 is a protrusion-type pattern and, as shown in FIG. 2, is a pattern in which the plurality of protrusions 44 are arranged and formed two-dimensionally to be spaced apart from each other, the arrangement pitch of protrusions 44 of the dummy pattern 40 is an average value of arrangement pitches Pda and Pdb in respective directions of two orthogonal axes. In a case of a pattern in which a plurality of protrusions 44 are arranged and formed to be spaced apart from each other in one direction, the arrangement pitch of the protrusions 44 of the dummy pattern 40 is the arrangement pitch of the protrusions 44 in the one direction.

In a case where the dummy pattern 40 is a recess-type pattern, for the arrangement pitch of the recesses 42 of the dummy pattern 40, the protrusions 44 are replaced with the recesses 42 in the above description.

In the master plate 20 as shown in FIG. 4, it is desirable that a height Hd of the protrusion 44 of the dummy pattern 40 is higher than a height Hs of the protrusion 34 of the product pattern 30. By setting Hd>Hs, the second surface area S2 can be easily made larger than the first surface area S1.

In the master plate 20, it is preferable that an aspect ratio of the protrusion 44 or the recess 42 of the dummy pattern 40 is larger than an aspect ratio of the protrusion 34 or the recess 32 of the product pattern 30. By making the aspect ratio of the protrusion 44 or the recess 42 of the dummy pattern 40 larger than the aspect ratio of the protrusion 34 or the recess 32 of the product pattern 30, the second surface area S2 can be easily made larger than the first surface area S1.

Here, the aspect ratio is a height of a protrusion/an equivalent circle diameter of an area of a protrusion or a recess in a plan view. For example, in a case where the product pattern 30 is a protrusion-type pattern, Aspect ratio=height *Hs* of protrusion 34/equivalent circle diameter *Ds* of area of protrusion 34 in plan view.

In a case where the dummy pattern 40 is a recess-type pattern,

Aspect ratio=height *Hs* of protrusion 34/equivalent circle diameter *Ds* of area of recess 32 in plan view.

Similarly, in a case where the dummy pattern 40 is a protrusion-type pattern, Aspect ratio=height *Hd* of protrusion 44/equivalent circle diameter *Dd* of area of protrusion 44 in plan view.

In addition, in a case where the dummy pattern 40 is a recess-type pattern,

Aspect ratio=height *Hd* of protrusion 44/equivalent circle diameter *Dd* of area of recess 42 in plan view.

It is preferable that the dummy region 25 comprises the recess 42 or the protrusion 44 having a size larger than the recess 32 or the protrusion 34 in the product region 23. The size larger than the recess 32 or the protrusion 34 in the product region 23 means that a product of the height Hd of the recess 42 or the protrusion 44 and the equivalent circle diameter Dd of the area in the plan view is larger than a product of the height Hs of the recess 32 or the protrusion 34 and the equivalent circle diameter Ds of the area in the plan view. In a case where the recesses 32 or the protrusions 34 having different sizes are included in the product region 23, the height and the equivalent circle diameter of the area in the plan view are the average values thereof. The same applies to a case where the recesses 42 or the protrusions 44 having different sizes are included in the dummy region 25.

In the master plate 20 as shown in FIG. 5, it is preferable that an angle θ2 formed by the side wall 44*a* of the protrusion 44 of the dummy pattern 40 and a bottom surface 42*b* of the recess 42 of the dummy pattern 40 is smaller than an angle θ1 formed by the side wall 34*a* of the protrusion 34 of the product pattern 30 and a bottom surface 32*b* of the recess 32 of the product pattern 30. By setting θ2<θ1, the adhesiveness of the dummy pattern 40 to the electrodeposition layer during electroforming can be made higher than that of the product pattern 30, and an anchor effect due to the dummy pattern 40 can be made higher. Therefore, the effect of suppressing peeling of a metal formed article that is growing in an electroforming step can be enhanced.

As shown in FIG. 6, it is preferable that the angle θ2 formed by the side wall 44*a* of the protrusion 44 of the dummy pattern 40 and the bottom surface 42*b* of the recess 42 of the dummy pattern 40 is 90° or less. By setting θ2 to 90° or less, more preferably less than 90°, the anchor effect due to the dummy pattern 40 during electrodeposition can be further enhanced. Therefore, the effect of suppressing peeling of a metal formed article that is growing in the electroforming step can be further enhanced.

Configuration examples 20A to 20G of the master plate 20 will be described with reference to FIGS. 7 to 13.

A manufacturing method of a metal formed article will be described later. In a case of manufacturing a product having an opening such as a nozzle plate, the master plate 20 comprises a conductive substrate 21 that has an electrodeposition surface, and a nonconductive mask that is formed on the substrate 21 and control growth of a metal formed article. In this case, the master plate 20 has a protrusion-type pattern, and the protrusion 34 of the product pattern 30 and the protrusion 44 of the dummy pattern 40 are formed by the nonconductive mask. That is, the protrusion 34 of the product pattern 30 and the protrusion 44 of the dummy pattern 40 are configured of a nonconductive material, and the protrusion 34 and the protrusion 44 consisting of the nonconductive material function as the nonconductive masks that controls growth of a metal formed article. The material of the nonconductive mask that forms at least one of the protrusion 34 of the product pattern 30 or the protrusion 44 of the dummy pattern 40 may be a photosensitive resin. In addition, the material of the nonconductive mask that forms at least one of the protrusion 34 of the product pattern 30 or the protrusion 44 of the dummy pattern 40 may be an inorganic material. As the conductive substrate 21, a metal substrate such as stainless steel is suitable.

A master plate 20A shown in FIG. 7 comprises a conductive substrate 21 and protrusions 34 and 44 as nonconductive masks on one surface of the substrate 21. The protrusions 34 and 44, which are the nonconductive masks, can be formed of a photosensitive resin. The master plate 20A shown in FIG. 7 can be produced, for example, as a photosensitive resin layer is formed on the substrate 21, exposed in a mask-patterned manner, and developed. In a case where both a product pattern 30 and a dummy pattern 40 comprise the protrusions 34 and 44 consisting of a photosensitive resin layer, there is an advantage that a metal formed article formed by electroforming is easily peeled from the master plate 20A.

A master plate 20B shown in FIG. 8 comprises a nonconductive substrate 22, a metal film 22*a* formed on one surface of the nonconductive substrate 22, and protrusions 34 and 44 as nonconductive masks on the metal film 22*a*. Similar to the master plate 20A, the protrusions 34 and 44 are formed of a photosensitive resin. As the nonconductive substrate 22, a glass substrate, a silicon substrate, or the like can be used. As described above, as a flat plate substrate, a conductive substrate or a nonconductive substrate can be used without limitation.

Similar to the master plate 20A, a master plate 20C shown in FIG. 9 comprises a conductive substrate 21 and protrusions 34 and 44 as nonconductive masks. The protrusions 34 and 44, which are the nonconductive masks, can be formed of an inorganic material instead of a photosensitive resin. Examples of the inorganic material include metal oxide, metal nitride, and metal fluoride. In the master plate 20C shown in FIG. 9, for example, film formation is performed by sputtering or the like in a state where a metal mask having an opening pattern corresponding to a desired protrusion-type pattern is disposed while being caused to face one surface of the substrate 21. Thereby, the protrusions 34 and 44 corresponding to the opening pattern can be formed. In a case where both a product pattern 30 and a dummy pattern 40 comprise the protrusions 34 and 44 consisting of an inorganic material, even after a metal formed article formed by electroforming is peeled from the master plate 20C, an uneven pattern of the master plate 20C can be left. Therefore, the master plate 20C can be repeatedly used, and a plurality of metal formed articles can be produced using one master plate 20C.

A master plate 20D shown in FIG. 10 comprises a conductive substrate 21 and protrusions 34 and 44 as nonconductive masks. In the master plate 20D, the protrusion 34 of a product pattern 30 is formed of a photosensitive resin, and the protrusion 44 of a dummy pattern 40 is formed of an inorganic material. Since the protrusion 34 of the product pattern 30 is a photosensitive resin, in a case of peeling a metal formed article, the metal formed article can be peeled without applying a large load to a product part. On the other hand, since the protrusion 44 of the dummy pattern 40 is formed of an inorganic material, the protrusion 44 remains on the substrate 21 even after the metal formed article is peeled. Therefore, the master plate 20D can be regenerated by re-forming only the protrusion 34 of the product pattern 30 on the substrate 21 after the metal formed article is peeled, and the master plate 20D can be used again for electroforming of a metal formed article.

A master plate 20E shown in FIG. 11 comprises a conductive substrate 21 and protrusions 34 and 44 as nonconductive masks. In the master plate 20E, the protrusion 34 of a product pattern 30 is formed of an inorganic material, and the protrusion 44 of a dummy pattern 40 is formed of a photosensitive resin. Since the protrusion 34 of the product pattern 30 is formed of an inorganic material, it remains on the substrate 21 even after a metal formed article is peeled. Therefore, the master plate 20E can be regenerated by re-forming only the protrusion 44 of the dummy pattern 40 on the substrate 21 after the metal formed article is peeled, and the master plate 20E can be used again for electroforming of a metal formed article.

In addition, in the master plate 20, at least one of the protrusion 34 of the product pattern 30 or the protrusion 44 of the dummy pattern 40 may be formed of a conductive material, and the other one may be formed of a nonconductive material. Specific aspects are shown in FIG. 12 and FIG. 13.

A master plate 20F shown in FIG. 12 is used in a case of manufacturing a product having an opening such as a nozzle plate, similarly to the master plates 20A to 20E shown in FIGS. 7 to 11. The master plate 20F comprises a metal substrate 28 in which a protrusion 44 of a dummy pattern 40 is integrally formed, and a protrusion 34 of a product pattern 30 as a nonconductive mask. In the master plate 20F, the protrusion 44 of the dummy pattern 40 is formed as a part of the metal substrate 28. The protrusion 34 of the product pattern 30 is formed of a nonconductive material. As the nonconductive material, a photosensitive resin or an inorganic material can be used. As the inorganic material, metal oxide, metal nitride, or metal fluoride can be used as described above.

On the other hand, in a case where a product is a mold such as a stamper for imprinting, both the recess 32 and the protrusion 34 that form the product pattern 30 in the product region 23 need to have conductivity during electroforming. A master plate 20G shown in FIG. 13 comprises a metal substrate 29 in which a protrusion 34 of a product pattern 30 is integrally formed, and a protrusion 44 of a dummy pattern 40 as a nonconductive mask. In the master plate 20G, the protrusion 34 of the product pattern 30 is formed as a part of the metal substrate 29. In the present example, the protrusion 44 of the dummy pattern 40 is formed of a nonconductive material. As the nonconductive material, a photosensitive resin or an inorganic material can be used as described above.

In a case of a master plate for a mold, as described above, both a recess 32 and a protrusion 34 that form a product pattern 30 in a product region 23 need to have conductivity during electroforming. However, as the master plate, both a product pattern and a dummy pattern may have a nonconductive surface. In this case, a metal film need only to be formed on a nonconductive electrodeposition surface of the master plate by sputtering or the like to be given conductivity before electroforming. That is, the electrodeposition surface in the master plate in the present disclosure includes an aspect in which the electrodeposition surface is nonconductive before the conductivity is given.

"Manufacturing Method of Metal Formed Article"

Next, a manufacturing method of a metal formed article using the master plate according to the embodiment of the present disclosure will be described. The manufacturing method of a metal formed article according to the embodiment of the present disclosure includes the electroforming step using a master plate. In the electroforming step, a metal formed article is grown by precipitating metal on the electroforming surface of the master plate in a state where the master plate is immersed in an electrolytic solution. Further, the manufacturing method of a metal formed article includes a peeling step of peeling a metal formed article from the master plate. A metal formed article is manufactured by executing the electroforming step and the peeling step.

Hereinafter, a manufacturing method of a metal formed article according to a first embodiment will be described. Here, a manufacturing method of a nozzle plate 100 having a plurality of nozzles 102 as a metal formed article will be described.

FIG. 14 is a perspective view showing a part of the nozzle plate 100 used for a recording head of an inkjet printer, which is an example of a metal formed article produced by the manufacturing method of a metal formed article according to the first embodiment.

The nozzle plate 100 is a plate-shaped member of which a planar shape is a rectangular shape, which is formed of electroforming metal such as nickel (Ni). In the nozzle plate 100, a plurality of substantially circular openings 102 (hereinafter, referred to as nozzles 102) that function as nozzles are two-dimensionally arranged and formed. The nozzle 102 is formed in a substantially circular shape, and a diameter thereof is, for example, 100 μm or less, and preferably 20 μm to 50 μm. In the recording head, the nozzle plate 100 is disposed in a posture in which a longitudinal direction corresponds to a main scanning direction X of the inkjet printer and a lateral direction corresponds to a sub-scanning direction Y. A length of the nozzle plate 100 in the main scanning direction X is 100 mm as an example, and a length of the nozzle plate 100 in the sub-scanning direction Y is 40 mm as an example.

As the master plate 20, as an example, the master plate 20A (refer to FIG. 7) having the protrusions 34 and 44 consisting of a mask formed of a nonconductive material on the conductive substrate 21 is used. In the master plate 20, the bottom surfaces of the recesses 32 and 42 of the product pattern 30 and the dummy pattern 40 are surfaces of the substrate 21, and a metal layer 101 to be the nozzle plate 100 grows from these portions. The growth of the metal layer 101 is suppressed in a portion of the mask (protrusions 34 and 44) consisting of a nonconductive material. As a result, an opening is formed in the portion of the mask. The opening serves as the nozzle 102 in the nozzle plate 100. In the present example, the protrusions 34 arranged in four rows are formed in a region of 100 mm×40 mm of the master plate 20 corresponding to an arrangement pitch and the number of the nozzles 102 of the nozzle plate 100 described above. A diameter DM of the protrusion 34 is larger than a diameter D of the nozzle 102, and is, for example, 150 μm to 200 μm. In addition, a thickness of the protrusion 34 is, as an example, 2 μm.

FIG. 15 is a diagram showing a manufacturing step of the nozzle plate 100. FIG. 15 shows a partial cross section including only three protrusions 34 of the product pattern 30 of the master plate 20 shown in FIG. 1A (S0). First, in an electroforming step S1, in a state where the master plate 20 is immersed in an electrolytic solution, the metal layer 101 is grown as an electrodeposition layer on the electrodeposition surface 20*a* by metal precipitated from the electrolytic solution.

During electroforming, the metal layer 101 grows from the bottom surface of the recess 32, while metal is not precipitated and the metal layer 101 does not grow on a surface of the protrusion 34 that is the nonconductive mask. The metal layer 101 gradually grows on the bottom surface of the recess 32. After that, as a thickness of the grown metal layer 101 exceeds the thickness of the protrusion 34, the metal layer 101 grows from a surface of the previously grown metal layer 101 also toward a side of the protrusion 34 to cover an edge portion of the protrusion 34. In a case where the metal layer 101 grows from the edge portion of the protrusion 34 toward a center of the protrusion 34, an opening is formed in the metal layer 101 with a position substantially at the center of the protrusion 34 as an opening center. The opening serves as the nozzle 102. In a case where the thickness of the metal layer 101 increases, since the metal layer 101 grows toward the center of the protrusion 34, an opening diameter of the nozzle 102 also gradually decreases. A diameter of the protrusion 34 is determined such that the nozzle 102 has a desired opening diameter in a case where the metal layer 101 is grown to a desired thickness. On the protrusion 34, the closer the metal layer 101 is to the bottom surface 32*b* of the recess 32, the more the growth of the metal layer 101 progresses. Therefore, as shown in FIG. 15, the closer the opening diameter of the nozzle 102 is to the bottom surface 32*b*, the smaller the opening diameter of the nozzle 102 is, and the farther the opening diameter of the nozzle 102 is from bottom surface 32*b*, the larger the opening diameter of the nozzle 102 is, and a cross section of the metal layer 101 configuring an inner wall surface of the nozzle 102 is arcuate. For example, as a reference of a target opening diameter of the nozzle 102, the opening diameter of the nozzle 102 closer to the bottom surface 32*b* is set. Then, the diameter of the protrusion 34 is determined such that the reference opening diameter of the nozzle 102 is the target opening diameter. The thickness of the metal layer 101 is, as an example, about 50 μm.

After the electroforming step, the metal layer 101 is peeled from the master plate 20 (peeling step S2). In this case, the protrusion 34 consisting of a photosensitive resin is peeled from the master plate 20 (here, substrate 21) together with the metal layer 101.

After that, the protrusion 34 adhering to the metal layer 101 is removed (mask removing step S3). Further, the nozzle plate 100 can be obtained by punching out the product region 23 using the alignment mark 31 as a mark.

The details of the electroforming step S1 will be described. FIG. 16 shows an example of an electroforming apparatus 130 used in the electroforming step S1. The electroforming apparatus 130 comprises an electroforming tank 132, a plate holding mechanism 135, an anode 139, and a circulation mechanism 140 for an electrolytic solution 134.

The electroforming tank 132 stores the electrolytic solution 134. An anode 139 is disposed in a part of an inner wall surface of the electroforming tank 132. During electroforming, the master plate 20 is immersed in the electrolytic solution 134 of the electroforming tank 132. In the electrolytic solution 134, the master plate 20 is disposed in a posture in which the electrodeposition surface 20*a* faces the anode 139. The anode 139 is configured to include electroforming metal such as a nickel pellet, and has a size capable of facing an entire region of the electrodeposition surface 20*a* on the master plate 20. Electroforming to the master plate 20 is performed in a state where the electrodeposition surface 20*a* of the master plate 20 and the anode 139 face each other.

In the present example, a part of a side wall of the electroforming tank 132 is inclined. An inclination direction of the side wall is a direction in which an upper opening of the electroforming tank 132 is wider than a bottom surface of the electroforming tank 132 because of inclination of the side wall, and an inclined angle of the side wall is, as an example, about 40° to about 50° with respect to a horizontal direction. The anode 139 is disposed along the inner wall surface of the inclined side wall in an inclined posture with respect to the horizontal direction.

The plate holding mechanism 135 comprises a holding part 136, a rotating shaft 137, and a rotating device 138. The holding part 136 holds the master plate 20 from a side of a surface opposite to the electrodeposition surface 20*a* of the master plate 20. The rotating shaft 137 is attached to the rear surface of the holding part 136 and extends in a normal direction of the rear surface of the holding part 136. The rotating device 138 rotates the holding part 136 via the rotating shaft 137. The holding part 136 holds the master plate 20 in the electroforming tank 132 such that the electrodeposition surface 20*a* of the master plate 20 faces the anode 139. That is, the master plate 20 is disposed in a posture in which the electrodeposition surface 20*a* is inclined from the horizontal direction.

The master plate 20 is held by the holding part 136 such that a center coincides with the rotating shaft 137. In a case where the rotating device 138 is driven, the master plate 20 rotates integrally with the holding part 136 via the rotating shaft 137 with the center coincident with the rotating shaft 137 as a center of rotation. The master plate 20 is set in the holding part 136 outside the electroforming tank 132, and is immersed in the electroforming tank 132 in a state of being held by the holding part 136. Then, electroforming is executed while rotating the master plate 20 about an axis extending in the normal direction from an in-plane center position of the electrodeposition surface 20*a*.

At a point of the electroforming, the electrodeposition surface 20*a* of the master plate 20 is a cathode, and the electrodeposition surface 20*a* serving as a cathode and the anode 139 including the electroforming metal are energized. As a result, the electroforming metal of the anode 139 is electrolyzed and dissolved into the electrolytic solution 134 as electric ions. Then, the metal layer 101 is formed as metal precipitated from the electrolytic solution 134 is electrodeposited on the electrodeposition surface 20*a* serving as a cathode.

The circulation mechanism 140 includes a storage tank 141, a discharge pipe 142, a valve 143, a pump 144, a filter 146, a supply pipe 147, and a nozzle 148. The circulation mechanism 140 circulates the electrolytic solution 134 stored in the electroforming tank 132 between the electroforming tank 132 and the storage tank 141 disposed outside the electroforming tank 132. By the circulation, the electrolytic solution 134 is made to flow between the electrodeposition surface 20*a* and the anode 139.

The discharge pipe 142 and the supply pipe 147 configure a circulation passage for the electrolytic solution 134 between the electroforming tank 132 and the storage tank 141. The discharge pipe 142 configures a return conduit for discharging the electrolytic solution 134 in the electroforming tank 132 and for returning the discharged electrolytic solution 134 to the storage tank 141 in the circulation passage. The supply pipe 147 configures a supply conduit for supplying the electrolytic solution 134 from the storage tank 141 to the electroforming tank 132 in the circulation passage.

One end of the discharge pipe 142 is disposed in the electroforming tank 132, and the other end is connected to the storage tank 141. The discharge pipe 142 returns the electrolytic solution 134, which exceeds a specified amount set in advance in the electroforming tank 132, to the storage tank 141. Therefore, one end of the discharge pipe 142 is disposed at substantially the same height as a liquid surface of the electrolytic solution 134 of the specified amount in a state where an opening of the discharge pipe 142 is directed upward. As a result, the electrolytic solution 134 that exceeds the specified amount in the electroforming tank 132 flows into the discharge pipe 142 and is returned to the storage tank 141 through the discharge pipe 142.

Also, one end of the supply pipe 147 is disposed in the electroforming tank 132, and the other end is connected to the storage tank 141. A nozzle 148 that injects the electrolytic solution 134 into the electroforming tank 132 is connected to one end of the supply pipe 147. The other end of the supply pipe 147 is connected to a lower part of the storage tank 141. A valve 143, a pump 144, and a filter 146 are disposed in this order from a side of the storage tank 141, which is an upstream side in a supply direction of the electrolytic solution 134, on the supply conduit configured of the supply pipe 147. The valve 143 opens and closes the supply passage. In a case where the supply passage is opened by the valve 143 in a state where the pump 144 is driven, supply of the electrolytic solution 134 from the storage tank 141 to the electroforming tank 132 is started. The filter 146 filters the electrolytic solution 134. The electrolytic solution 134 that has passed through the filter 146 is supplied into the electroforming tank 132 through the supply pipe 147. The nozzle 148 injects the electrolytic solution 134 toward an area between the electrodeposition surface 20*a* of the master plate 20 and the anode 139.

As described above, in the electroforming step S1, the electrolytic solution 134 is circulated between the electroforming tank 132 and the storage tank 141 by using the circulation mechanism 140. Further, in the electroforming tank 132, the electrolytic solution 134 is made to flow in a direction in which a fluid pressure of the electrolytic solution 134 is added toward the electrodeposition surface 20*a*, by injecting the electrolytic solution 134 by the nozzle 148 toward the area between the electrodeposition surface 20*a* and the anode 139. It is preferable that the electroforming step S1 is executed while making the electrolytic solution 134 flow as described above.

As described above, the electroforming is performed on the electrodeposition surface 20*a* of the master plate 20.

In the master plate 20 used in the manufacturing method described above, the surface area per unit area of the dummy region 25 is larger than the surface area per unit area of the product region 23. Therefore, in the electroforming step, a high anchor effect can be exhibited with respect to a metal layer precipitated and formed on the electrodeposition surface 20*a* of the master plate 20, and adhesiveness between the metal layer and the master plate 20 can be further enhanced. Therefore, the effect of suppressing peeling of the metal layer from the master plate 20 can be sufficiently exhibited during electroforming.

In the manufacturing method described above, it is preferable that a water contact angle of the surface of the protrusion 34 of the product pattern 30 of the master plate 20 is 20° or less.

In the manufacturing method described above, in a case where the water contact angle of the surface of the protrusion 34 is large, air bubbles may adhere to the surface of the protrusion 34, and the air bubbles may cause a forming defect of an opening. The present inventor estimates mechanism of the forming defect of an opening caused by the air bubbles as follows. In a case where the air bubbles adhere to the mask, that is, the protrusion 34, the metal layer that grows to cover the edge portion of the mask grows while entraining the air bubbles. In a case where the metal layer entrains the air bubbles, the metal layer encompassing the air bubbles is formed by swelling larger than the other portions. As described above, in a case where the metal layer is formed by swelling at the edge portion of the mask, the metal layer bulges from the edge portion of the mask toward a central portion of the mask. As the metal layer bulges toward a center of the mask, a size of an opening is smaller in diameter, or a shape of an opening, which should be a circular shape, is a crescent shape, which causes the forming defect of an opening.

That is, in a case where the air bubbles do not adhere to the surface of the protrusion 34, the forming defect of an opening can be suppressed. Here, by setting the water contact angle of the surface of the protrusion 34 to 20° or less, the adhesion of air bubbles to the surface of the protrusion 34 during electroforming can be suppressed. Therefore, by setting the water contact angle on the surface of the protrusion 34 to 20° or less, the forming defect of an opening can be suppressed.

In a case where the protrusion 34 is configured of a photosensitive resin as in the present example, a water contact angle of a general photosensitive resin layer is very large, and for example, exceeds 80°. In order to make the water contact angle of the photosensitive resin layer to 20° or less, a hydrophilization treatment needs only to be performed to a surface of the master plate 20.

A method for the hydrophilization treatment is not particularly limited, but oxygen plasma ashing treatment or ultraviolet ray ozone treatment is preferable.

Here, an example of the manufacturing method of the master plate will be described with reference to FIG. 17.

First, in a coating step S11, a photosensitive resin film 33 is applied and formed on a surface of the substrate 21.

Next, in an exposure step S12, a mask 36 for pattern formation is disposed on the photosensitive resin film 33, and the photosensitive resin film 33 is subjected to pattern exposure.

Then, in a developing step S13, the exposed photosensitive resin film 33 is developed and washed, whereby the master plate 20 comprising the protrusion 34 consisting of a photosensitive resin, that is, the nonconductive mask on the surface of the substrate 21 is obtained.

Then, before the electroforming step, a hydrophilization treatment S14 is performed to the electrodeposition surface 20*a*. As the hydrophilization treatment, the oxygen plasma ashing treatment or the ultraviolet ray ozone treatment is performed. Accordingly, the master plate 20 in which the water contact angle of the surface of the protrusion 34 is 20° or less can be obtained. The water contact angle is measured using a contact angle meter, and a value obtained by taking an average value of 10 points is used.

As described above, by hydrophilizing the electrodeposition surface 20*a* of the master plate 20 and setting the water contact angle of the surface of the protrusion 34 to 20° or less, an effect of removing air bubbles can be obtained, and occurrence of the crescent defects described above can be suppressed. On the other hand, the present inventor has found that, in a case of performing the oxygen plasma ashing treatment as the hydrophilization treatment, the electrodeposition layer is likely to be peeled off from the electrodeposition surface during electroforming. On the other hand, by providing the dummy pattern separately from the product pattern as in the master plate 20 according to the embodiment of the present disclosure, the peeling of the metal layer precipitated during electroforming from the master plate 20 can be suppressed. In addition, in the master plate 20, since the surface area per unit area of the dummy region is larger than the surface area per unit area of the product region, a high anchor effect can be exhibited and the adhesiveness can be further enhanced. Therefore, in a case where the hydrophilization treatment by the oxygen plasma ashing treatment is performed to the electrodeposition surface 20*a* in order to prevent adhesion of air bubbles, and the master plate 20 is used, the master plate 20 is particularly effective.

Next, a manufacturing method of a metal formed article according to a second embodiment will be described. Here, a manufacturing method for a mold 110 having a plurality of protrusions as a metal formed article will be described.

FIG. 18 is a perspective view showing a part of the mold 110, which is an example of the metal formed article produced by the manufacturing method of a metal formed article according to the second embodiment.

The mold 110 is formed of electroforming metal such as Ni. In the mold 110, a plurality of protrusions 112 are two-dimensionally arranged and formed.

FIG. 19 is a diagram showing a manufacturing step of the mold 110. As shown in FIGS. 1A and 2, the master plate 20 comprises the product pattern and the dummy pattern, however, FIG. 19 shows a partial cross section including three protrusions 34 of the product pattern 30 of the master plate 20. The master plate 20 used in the present example has a circular outer shape, but an outer shape is not limited to a circular shape.

The master plate 20 shown in S20 in FIG. 19 is consisting of a nonconductive substrate obtained as an uneven pattern is formed on a surface. As a pretreatment S21 of the electroforming step, a metal film 111*a* is formed on the electrodeposition surface 20*a* of the master plate 20. Thereby, conductivity is imparted to the electrodeposition surface 20*a*.

Next, in an electroforming step S22, in a state where the master plate 20 is immersed in the electrolytic solution, a metal layer 111*b* is grown on the metal film 111*a* by the metal precipitated from the electrolytic solution. In the present example, since the metal film 111*a* is formed over the entire uneven pattern of the surface of the master plate 20, the metal layer 111*b* grows on all the surfaces of the bottom surfaces of the recesses 32 and 42 and the surfaces of the protrusions 34 and 44. In a case where metal materials of the metal film 111*a* and the metal layer 111*b* are the same, a boundary between the metal film 111*a* and the metal layer

111*b* cannot be distinguished from each other, and the metal film 111*a* and the metal layer 111*b* becomes an integrated metal layer 111.

After the electroforming step, the metal layer 111 is peeled from the master plate 20 (peeling step S23). The metal layer 111 has an uneven pattern to which the product pattern and the dummy pattern, which are formed on the electrodeposition surface of the master plate 20, are transferred, and the mold 110 having the protrusion 112 shown in FIG. 19 is obtained.

Also in the present example, in the present master plate 20, since the surface area per unit area of the dummy region is larger than the surface area per unit area of the product region, a high anchor effect can be exhibited and occurrence of peeling of the metal layer 111 during electroforming can be suppressed. In particular, in the case of a microchannel or the like in which a density of an uneven pattern in the product pattern is sparse, since adhesiveness between the master plate and the electrodeposition layer in the product pattern is small, a high peeling suppression effect can be obtained by comprising the dummy pattern of which a surface area per unit area is large.

The disclosure of JP2021-008220, filed on Jan. 21, 2021, is incorporated herein by reference in its entirety.

All documents, patent applications, and technical standards described herein are incorporated by reference herein to the same extent as specifically and individually stated that the individual documents, patent applications, and technical standards are incorporated by reference.

What is claimed is:

1. A master plate having an electrodeposition surface in which a metal formed article is formed by electrodeposition, and having a product region in which a product part, which is cut out as a product from the metal formed article, is formed and a non-product region other than the product region in the electrodeposition surface, the master plate comprising:

a product pattern that is formed in the product region and includes a recess and a protrusion; and a dummy pattern that is formed in at least a partial region of the non-product region and includes a plurality of recesses and a plurality of protrusions, wherein a surface area of the product pattern per unit area of the product region is smaller than a surface area of the dummy pattern per unit area of a dummy region in which the dummy pattern is formed, wherein the plurality of recesses or the plurality of protrusions are regularly arranged in the dummy region, wherein the product pattern includes at least one of a plurality of recesses or a plurality of protrusions, which are regularly arranged in the product pattern, and wherein an arrangement pitch of the plurality of recesses or the plurality of protrusions of the dummy pattern is smaller than an arrangement pitch of the plurality of recesses or the plurality of protrusions of the product pattern.

2. The master plate according to claim 1, wherein an area of the dummy region is larger than that of the product region.

3. The master plate according to claim 1, wherein an average of aspect ratio of the plurality of protrusions or the plurality of recesses of the dummy pattern is larger than an average of aspect ratio of the plurality of protrusions or the plurality of recesses of the product pattern.

4. The master plate according to claim 1, wherein the dummy pattern has a bottom surface and the plurality of protrusions protrude from the bottom surface, and angles formed by side walls of the plurality of protrusions and the bottom surface of the dummy pattern are 90° or less.

5. The master plate according to claim 1, wherein a planar shape of the electrodeposition surface is a circular shape, and three of the product regions are provided around a center of the electrodeposition surface in a three-fold rotationally symmetric manner, and the dummy pattern is provided in a region surrounded by the three product regions.

6. The master plate according to claim 1, wherein the master plate includes a conductive substrate that has the electrodeposition surface, and a nonconductive mask that is formed on the electrodeposition surface and controls growth of the metal formed article, and the plurality of protrusions of the product pattern and the plurality of protrusions of the dummy pattern are formed by the nonconductive mask.

7. The master plate according to claim 6, wherein a material of the nonconductive mask forming at least one of the plurality of protrusions of the product pattern or the plurality of protrusions of the dummy pattern is a photosensitive resin.

8. The master plate according to claim 6, wherein a material of the nonconductive mask forming at least one of the plurality of protrusions of the product pattern or the plurality of protrusions of the dummy pattern is an inorganic material.

9. The master plate according to claim 1, wherein one of the plurality of protrusions of the product pattern or the plurality of protrusions of the dummy pattern is formed of a conductive material, and another of the plurality of protrusions of the product pattern or the plurality of protrusions of the dummy pattern is formed of a nonconductive material.

10. A manufacturing method of a metal formed article, the method comprising:

an electroforming step of growing, in a state where the master plate according to claim 1 is immersed in an electroforming liquid, the metal formed article by precipitating metal on the electrodeposition surface; and a peeling step of peeling the metal formed article from the master plate.

11. The manufacturing method of a metal formed article according to claim 10, wherein a water contact angle of a surface of the protrusion of the product pattern of the master plate is 20° or less.

12. A master plate having an electrodeposition surface in which a metal formed article is formed by electrodeposition, and having a product region in which a product part, which is cut out as a product from the metal formed article, is formed and a non-product region other than the product region in the electrodeposition surface, the master plate comprising:

a product pattern that is formed in the product region and includes a recess and a protrusion; and a dummy pattern that is formed in at least a partial region of the non-product region and includes a plurality of recesses and a plurality of protrusions, wherein a surface area of the product pattern per unit area of the product region is smaller than a surface area of the dummy pattern per unit area of a dummy region in which the dummy pattern is formed, wherein an average height of the plurality of protrusions of the dummy pattern is higher than an average height of the plurality of protrusions of the product pattern.

13. A master plate having an electrodeposition surface in which a metal formed article is formed by electrodeposition, and having a product region in which a product part, which is cut out as a product from the metal formed article, is formed and a non-product region other than the product region in the electrodeposition surface, the master plate comprising:

a product pattern that is formed in the product region and includes a recess and a protrusion; and a dummy pattern that is formed in at least a partial region of the non-product region and includes a plurality of recesses and a plurality of protrusions, wherein a surface area of the product pattern per unit area of the product region is smaller than a surface area of the dummy pattern per unit area of a dummy region in which the dummy pattern is formed, wherein each of the dummy pattern and the product pattern has a bottom surface and the protrusion protruding from the bottom surface, and angles formed by side walls of the plurality of protrusions and the bottom surface of the dummy pattern are smaller than angles formed by side walls of the plurality of protrusions and the bottom surface of the product pattern.

* * * * *